United States Patent [19]

Ewalds et al.

[11] Patent Number: 5,005,393

[45] Date of Patent: Apr. 9, 1991

[54] ELECTRONIC KEY LOCKS

[75] Inventors: Johannes M. Ewalds, Delft; Johan C. Hordijk, Oosterhout; Evert Nieuwkoop, Pijnacker, all of Netherlands

[73] Assignee: Chubb Lips Nederland bv, Dordrecht, Netherlands

[21] Appl. No.: 508,340

[22] Filed: Apr. 10, 1990

[30] Foreign Application Priority Data

Apr. 13, 1989 [GB] United Kingdom ..... 8908386

[51] Int. Cl.[5] ..... E05B 47/00

[52] U.S. Cl. ..... 70/277; 70/134

[58] Field of Search ..... 70/278, 277, 276, 279–283, 70/134

[56] References Cited

U.S. PATENT DOCUMENTS

| | | | |
|---|---|---|---|
| 4,616,491 | 10/1986 | Genest | 70/276 |
| 4,633,687 | 1/1987 | Fane | 70/278 |
| 4,771,620 | 9/1988 | Kleinhany | 70/277 |
| 4,789,859 | 12/1988 | Clarkson | 70/278 |

*Primary Examiner*—Robert L. Wolfe

*Attorney, Agent, or Firm*—Jerry A. Miller

[57] ABSTRACT

A lock which is adapted to transduce the code from a key by electronic means is constructed to resemble the form and functionality of a conventional mechanical cylinder lock. A main casing houses the bolt, a rotatable thrower or cam for retracting the bolt, an electromechanical release mechanism which normally blocks rotation of the thrower, and a processor to control the release mechanism in response to the detected key code. The electronic reading means are located in association with the keyway of a rotatable barrel in a cylinder unit manufactured as a separate unit from the main casing. The thrower and barrel have respective cooperating mechanical couplings and the main casing and cylinder unit have respective cooperating electrical connectors. The lock is therefore assembled by attaching the cylinder unit to the outside of the main casing, thus establishing a rotary driving connection from the barrel to the thrower and establishing an electrical connection from the key reader to the processor.

10 Claims, 3 Drawing Sheets

ELECTRONIC KEY LOCKS

BACKGROUND

The present invention relates to locks and more particularly to "electronic" key locks of the kind comprising: a bolt; a rotatable thrower for retracting the bolt; an electromechanical release mechanism which normally prevents retraction of the bolt when thrown but which can be actuated to permit such retraction; a rotatable barrel defining a keyway to receive and be turned by a proper coded key; reading means associated with the keyway for electronically transducing the code from a proper key; and processing means to receive the code transduced by said reading means and to issue a signal to actuate said release mechanism upon the recognition of a correct code.

Electronic key locks are well known, at least in the patent literature, and have been proposed in conjunction with diverse methods of key code detection. It is recognised that, both in the interests of user acceptance and to maximise the utilisation of standard lock components and furniture, the overall appearance, dimensions and functionality of such locks should resemble those of conventional mechanical key locks as far as practicable. A universally known style of mechanical key lock is the conventional cylinder lock, comprising a main casing which houses the bolt and which receives a locking cylinder unit through an aperture therein. The cylinder unit comprises a barrel journalled in the cylinder body and normally blocked against rotation by a series of mechanical tumblers extending across the shear line, but which can be freed for rotation by the insertion of a properly profiled key. At the rear end of the cylinder unit, where it is received within the main casing, the cylinder body bears a thrower (frequently termed a cam) to which the barrel is coupled and the turning of which retracts the bolt.

In the past attempts have been made to embody an electronic key lock in an equivalent structure to that of the conventional mechanical cylinder unit described above. Thus in U.S. patent specification No. 4771620 there is shown an electronic cylinder unit with an equivalent cylinder body, barrel and thrower, but where release of the barrel for rotation is controlled by a solenoid located in the part of the cylinder body which surrounds the barrel and which is actuated in response to the reading of a correct code through electrical contacts on the key. We believe, however, that while meeting the desire for physical resemblence to a conventional cylinder unit, this structure has several disadvantages. Firstly, electrical connections are required from the reading contacts to a processing module outside the cylinder unit and back to the solenoid, which may be difficult to make and vulnerable to attacks. Secondly, it may be possible to attack the lock by forcibly extracting the barrel from the cylinder unit or by forcibly extracting the cylinder unit from the main casing, thus leaving the bolt unblocked and easy to manipulate. Thirdly, the location of the solenoid in the outer portion of the cylinder unit places constraints upon its size, could make it vulnerable to certain kinds of attack and leaves no room in the cylinder body for extra electronics; for example, if a high frequency inductively-coupled key reading system is chosen, it is desirable to have the oscillator circuit for the radiating field as close as possible to the reading head.

SUMMARY OF THE INVENTION

Accordingly, in one aspect the present invention resides in a lock comprising: a bolt; a rotatable thrower for retracting the bolt; an electromechanical release mechanism which normally prevents retraction of the bolt when thrown but which can be actuated to permit such retraction; a rotatable barrel defining a keyway to receive and be turned by a proper coded key; reading means associated with the keyway for electronically transducing the code from a proper key; and processing means to receive the code transduced by said reading means and to issue a signal to actuate said release mechanism upon the recognition of a correct code; said bolt, thrower, and release mechanism being housed within a main casing of the lock; said barrel and reading means being housed within a cylinder unit distinct from said main casing; said processing means being disposed within said main casing or being in communication therewith from a remote location; said thrower and barrel having respective cooperating mechanical coupling means and said main casing and cylinder unit having respective cooperating electrical connector means; whereby the lock is assembled by attaching the cylinder unit exteriorly of the main casing thereby to establish a rotary driving connection from the barrel to the thrower through said mechanical coupling means and to establish an electrical connection from the reading means to the processor through said electrical connector means.

The aforesaid cylinder unit, or at least its outer portion, can be dimensioned and configured to resemble a conventional mechanical cylinder unit, so that the lock gives the same impression of form and functionality to the user as the cylinder locks with which he will be familiar. At the same time, the structure of a lock according to the invention may exhibit several advantages over the prior art electronic cylinder lock structure discussed above. Firstly, fewer electrical connections between the cylinder unit and the main casing should be necessary, which in a preferred embodiment are made by a single set of multi-pin plug-and-socket connector means. Secondly, even if the barrel could be extracted from the cylinder unit or the cylinder unit detached from the main casing (with consequent uncoupling of said mechanical coupling means), the bolt will remain secure by virtue of the release mechanism disposed within the main casing. Thirdly, the release mechanism is itself removed to a position of safety within the main casing and does not occupy space which may be at a premium within the cylinder unit.

BRIEF DESCRIPTION OF THE DRAWINGS

These and other features of the present invention will now be more particularly described, by way of example, with reference to the accompanying drawings, in which.

DETAILED DESCRIPTION OF THE INVENTION

Figure 1:
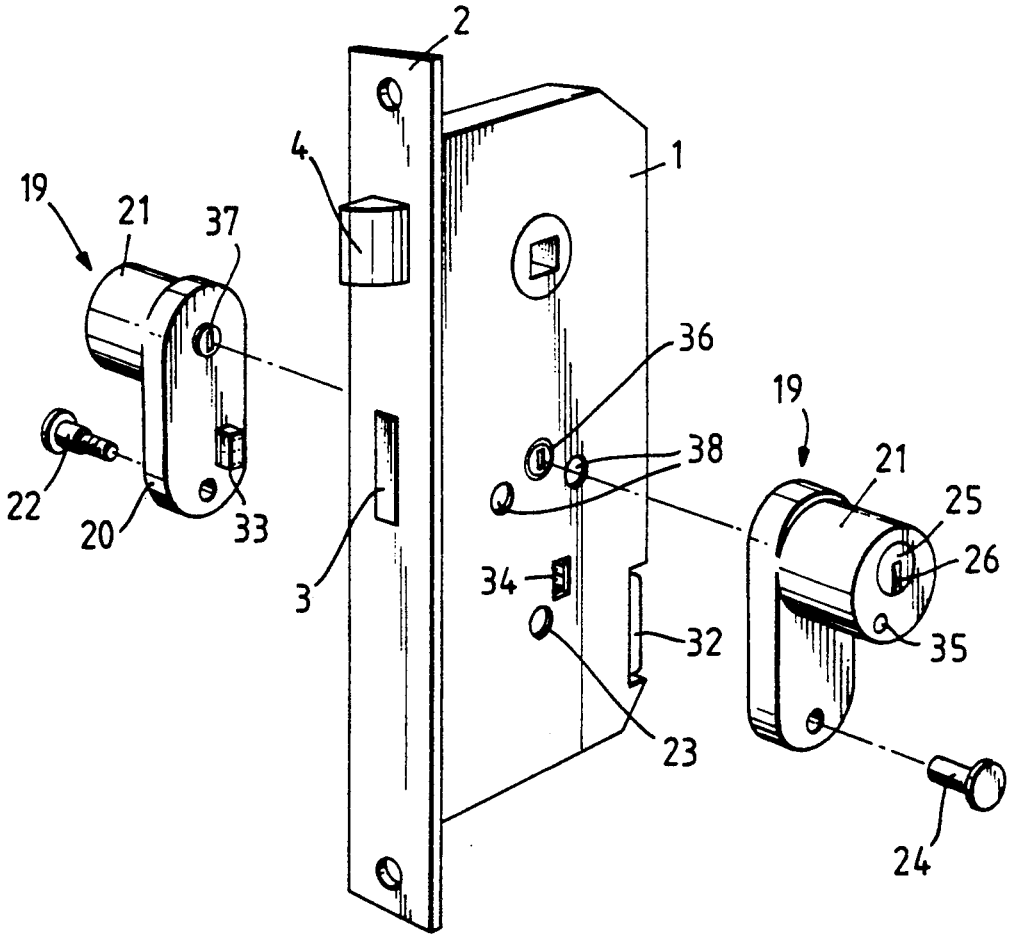
FIG. 1 is a partially "exploded" external perspective view of one embodiment of an electronic key-operated door lock in accordance with the invention.

With reference to the Figures, the illustrated lock is of mortice style having a main casing 1 with a forend 2 though which extend a dead bolt 3 and a latch bolt 4. Extension and retraction of the dead bolt 3 is in response to rotation in an appropriate sense of an internal thrower 5 having a radial lug 6 which drives the bolt through the agency of a runner 7 moving along an arcuate track, the geometry of the runner/bolt relationship being such as to deadlock the bolt against end pressure when thrown. Retraction of the latch bolt 4 is in response to the turning of a cam 8 by means of external handles (not shown) and is likewise accomplished, via a linkage 9, by rotation of the thrower 5 to withdraw the dead bolt. As thus far described, the function of the mechanism is conventional and (apart from the thrower 5) employs standard lock components.

Figure 2:
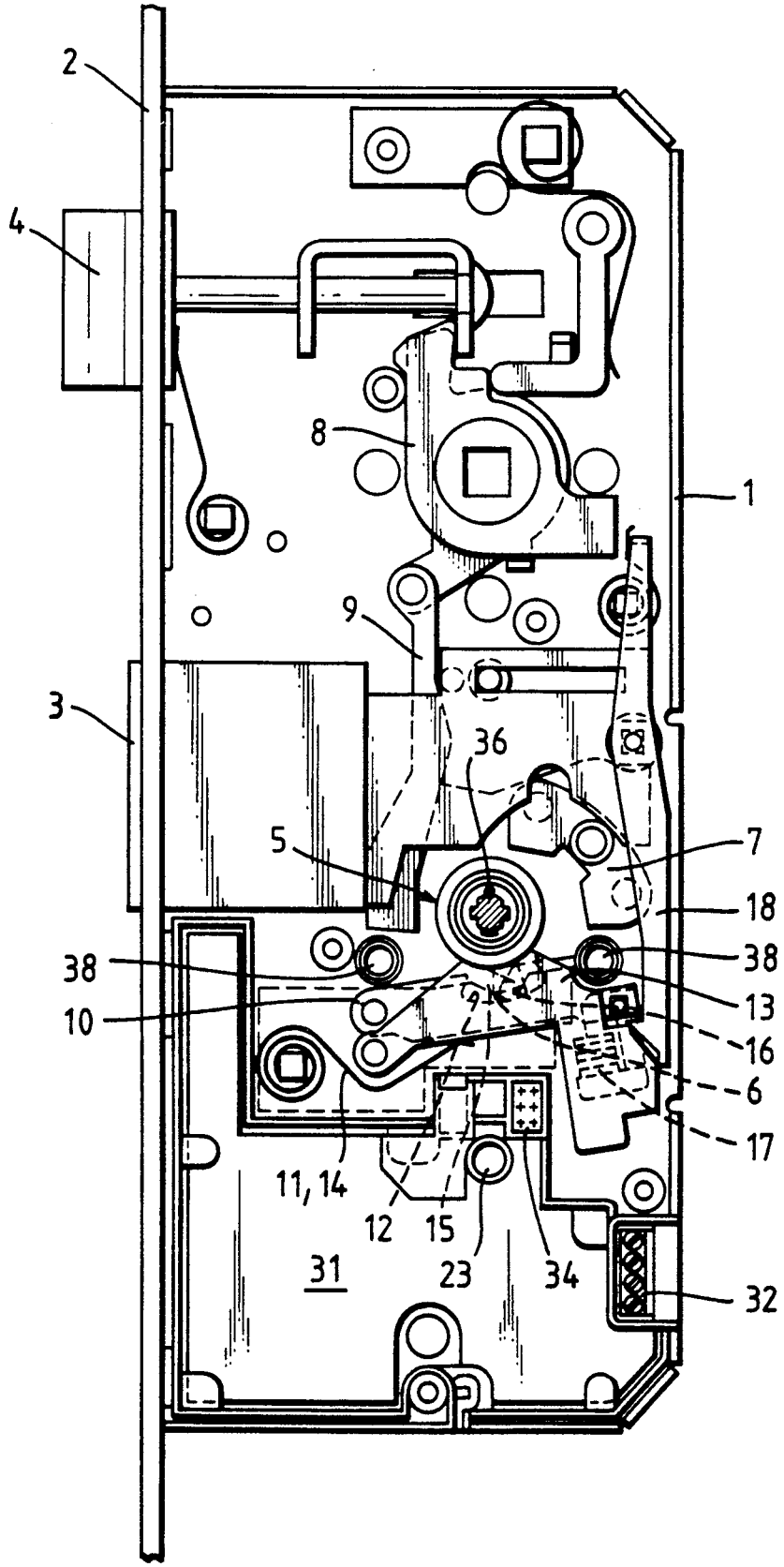
FIG. 2 is an interior view of the lock of FIG. 1, to an enlarged scale.

In a comparable lock employing a conventional mechanical cylinder unit as the key-recognition means the thrower (or "cam") would be part of the cylinder unit received through an aperture in the main casing and would normally be blocked against rotation by the mechanical tumblers in the cylinder unit. In the present case, however, the thrower 5 is journalled directly within the casing 1 and its movement is controlled by an electromechanical release mechanism housed within the same casing. A preferred form of electromechanical release mechanism is the subject of the copending U.S. patent Ser. No. 07/508,394 filed concurrently herewith and assigned to the same assignee as the present application, but will be briefly described herein with reference to FIG. 2.

That is to say, turning of the thrower 5 through a sufficient angle to shift the bolt 3 is normally blocked by a dogging lever 10 biased by a spring 11 and having a cut-out 12 within which the thrower lug 6 lies. In parallel with the lever 10 is a second lever 13 being biased by a spring 14 and having a cam track 15 in one of its flanks within which a lateral pin 16 on the thrower lug 6 engages when the thrower is in its illustrated rest position. Turning of the thrower 5 in either sense through the limited angle permitted by the cut-out 12 therefore causes the lever 13 to pivot downwards as the pin 16 runs along the cam track 15 but this movement normally has no effect on the lever 10 which accordingly keeps the thrower blocked. The lever 13, however, also carries an electromagnet 17. So long as this electromagnet remains de-energized it has no effect on the lever 10. However, when the magnet 17 is energized, which takes place in response to the recognition of a correct key code presented to either of the cylinder units 19 described below, it effectively holds the dogging lever 10 to the lever 13. In this condition, when the thrower 5 is turned through its initial angle the lever 10 is accordingly pivoted downwards together with the lever 13; the thrower lug 6 can therefore clear the cut-out 12 and continued 360° rotation of the thrower is permitted to extend or retract the bolt 3. An additional spring-biased detent lever 18 is also shown, which positively blocks the lever 10 from moving with the lever 13 except when the magnet 17 is energized.

Returning to FIGS. 1 and 3, mounted externally to respective sides of the main casing 1 are a pair of cylinder units 19. Each such unit has a housing formed with a rear section 20 and a forward section 21 which latter is presented to the user when the lock is installed in a door. The section 21 is shaped and dimensioned to resemble the forward section of a selected standard mechanical cylinder unit and, in addition to the circular profile shown, other embodiments may be produced e.g. with sections 21 of oval or "Europrofile" shape. These cylinder units 19 are secured by a bolt-through fixing comprising a screw 22 passing through the rear section 20 of the cylinder unit on the inside face of the door, through apertures 23 in the main casing 1, and into a threaded cap 24 held in the rear section 20 of the cylinder unit on the outside face of the door.

Figure 3:
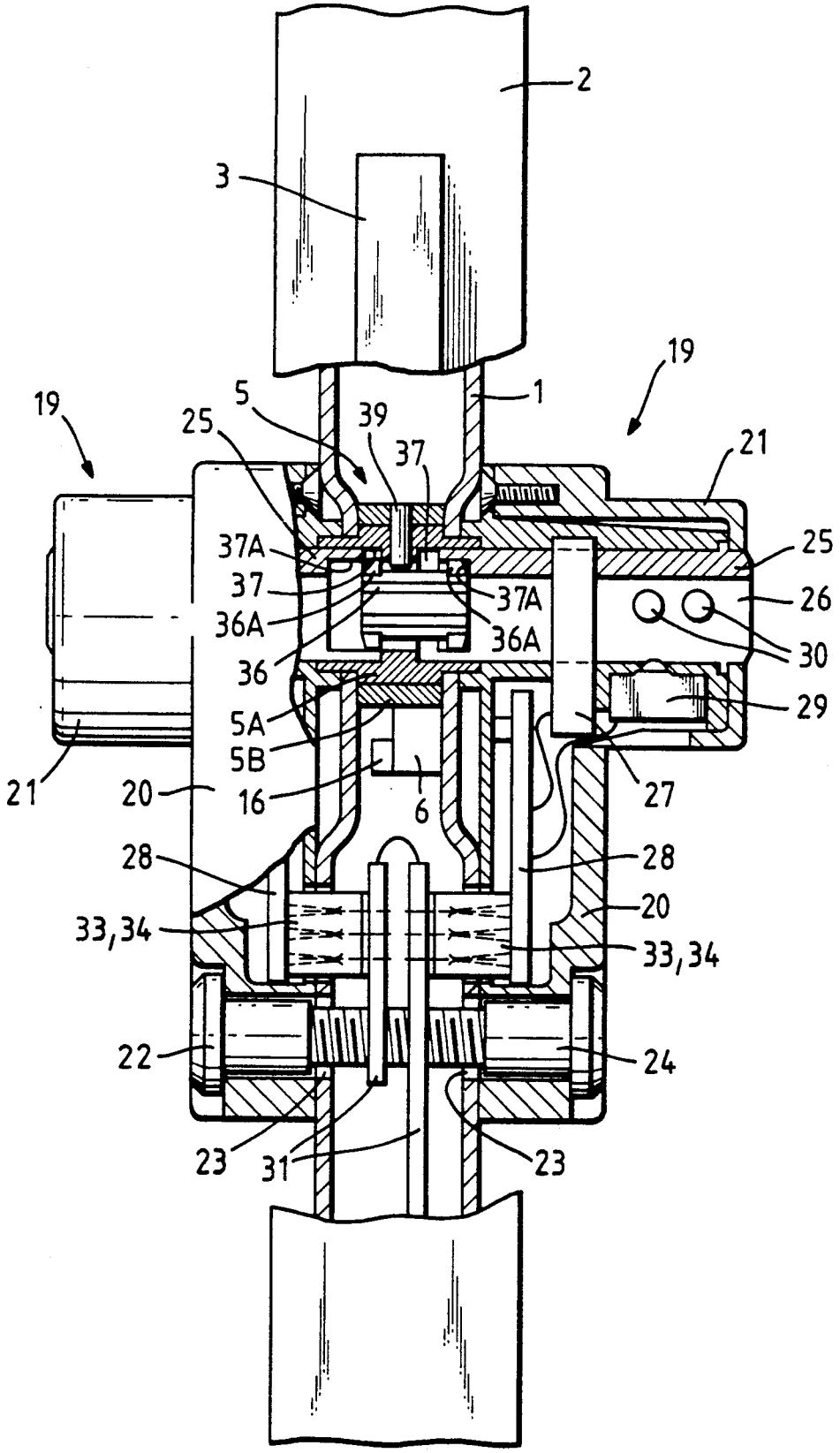
FIG. 3 is a partial vertical cross-section parallel to the forend of the lock of FIGS. 1 and 2, to a further enlarged scale and with some parts omitted for clarity.

Within each cylinder unit 19 is a rotatable barrel 25 with a keyway 26 of generally rectangular section to receive the flat bit of a corresponding key. Associated with each keyway 26 are means for electronically transducing a code signal from a proper key when inserted therein. In principle, any known form of electronic key code recognition could be employed, although in the preferred embodiment code transduction is by way of an inductively-coupled transponder method e.g. as described in International patent application No. WO88/03594. As shown in FIG. 3, therefore, each cylinder unit includes a reading head or antenna 27 driven by an oscillator mounted on a PCB 28 in the corresponding housing section 20 to generate an alternating magnetic field in a localised region of the keyway 26 which will be modulated by a coded integrated circuit transponder on the proper key when inserted in the keyway. A switch 29 is also provided to actuate the oscillator only when a key is present. In addition, mechanical tumbler pins can also be included, e.g. where indicated at 30 in FIG. 3, if combined mechanical and electronic coding of the key is desired. At least one such tumbler will normally be included to hold the barrel in its key-insertion position in the absence of the key.

The processing electronics which serve to determine if a presented key code is valid, and if so to energize the electromagnet 17 of the release mechanism to permit full turning of the thrower 5, are mounted on a pair of interconnected PCBs 31 within the main lock casing 1. As an alternative to an internal processor, communication may be effected through a connector 32 in the rear of the main casing a remotely located central processor, e.g. where the lock is part of an overall access-control system for a building. In either case, communication between the processor and the reading means in each cylinder unit 19 is established by a multi-pin plug connector 33 in the rear of each cylinder unit and a respective socket 34 in each side of the main casing. Electrical energy for the internal electronics and for the electromagnet 17 is supplied via a lead to the connector 32 from a battery pack (not shown) housed in another mortice in the door. In the unlikely event of power failure (the lock will have a low battery level warning circuit sounding an internal buzzer), an emergency supply can be connected through a normally-sealed socket 35 (FIG. 1) in the face of either cylinder unit 19.

The mechanical connection between each cylinder barrel 25 and the thrower 5 is effected as follows. The thrower has a central aperture of selected non-circular cross-section within which is received a complementary coupling element 36 with flanged end portions 36A. The element 36 is in a permanent torque-transmitting relationship to the thrower (or at least to its central portion) but is permitted a limited degree of axial movement therewithin. At the rear of each cylinder barrel 25 there is a drive socket 37 of non-circular cross-section complementary to the respective end portion 36A of the coupling element 36, but inward of that socket is another socket portion 37A of circular cross-section. While the corresponding end portion 36A of the coupling element lies within the socket 37, therefore, the respective barrel 25 is in a torque-transmitting relationship to the element 36 and hence to the thrower 5. While the corresponding end portion 36A of the coupling element lies within the barrel socket portion 37A, however, no torque can be transmitted between them. The effect of inserting a proper key into either keyway 26 is to shift the coupling element 36 by contact therewith so that its corresponding end portion 36A lies in the socket 37 of the respective barrel 25. In FIG. 3 this relationship is shown for the barrel on the left hand side of the drawing. The other consequence is that the portion 36A at the other end of the coupling element lies in the socket portion 37A of the opposite barrel 25, as also shown in FIG. 3. Therefore a torque-transmitting relationship is established from the barrel 25 in which the key is inserted to the thrower 5, but these elements can turn without hindrance from the opposite barrel.

When installing the illustrated lock, the main casing 1 is first mounted in its mortice in the door and the respective cylinder units 19 are offered to it through apertures in the opposite door faces formed to accommodate their housing sections 20. The necessary electrical and mechanical connections between each cylinder unit and the main casing are accomplished simply and reliably through the respective connectors 33/34 and couplings 36/37. The cylinder units are secured by the fixings 22/24 and can then be covered by standard furniture plates (not shown) apertured to pass their housing sections 21. Bolt-through fixings for the furniture plates can be accomplished via apertures 38 in the main lock casing. Of course in certain installations key operation from one side only of the door may be required. In such case, a cylinder unit 19 will be provided only on the side required, and a thumb-turn or other such member coupled to the thrower 5 from the other side.

The cylinder units 19 are so shaped that their housing sections 20 can be overlaid by furniture plates at positions both above and below their sections 21, offering high security against attempts to forcibly extract a cylinder unit from the lock. Even if such an attempt should succeed, however, or if the barrel 25 could be forcibly extracted from a unit, thereby presenting direct access to the coupling element 36, the thrower 5 will remain blocked by the dogging lever 10 within the main casing 1 and the bolt 3 cannot therefore be manipulated. To prevent excessive torque being applied through the thrower lug 6 to the dogging lever in an attempt to compromise the lock, the thrower is in fact made in two circumjacent parts 5A and 5B, held together by a shear pin 39 (FIG. 3). In the event of a torque attack the pin 39 will break before any damage can be done to the other components, whereafter the coupling 36 and thrower part 5A will simply freewheel and no further torque can be applied to the lug 6.

We claim:

1. A lock comprising: a bolt; a rotatable thrower for retracting the bolt; an electromechanical-release mechanism which normally prevents retraction of the bolt when thrown but which can be actuated to permit such retraction; a rotatable barrel defining a keyway to receive and be turned by a proper coded key; reading means associated with the keyway for electronically transducing the code from a proper key; and processing means to receive the code transduced by said reading means and to issue a signal to actuate said release mechanism upon the recognition of a correct code;

said bolt, thrower, and release mechanism being housed within a main casing of the lock;

said barrel and reading means being housed within a cylinder unit distinct from said main casing;

said processing means being disposed within said main casing or being in communication therewith from a remote location;

said thrower and barrel having respective cooperating mechanical coupling means and said main casing and cylinder unit having respective cooperating electrical connector means;

whereby the lock is assembled by attaching the cylinder unit exteriorly of the main casing thereby to establish a rotary driving connection from the barrel to the thrower through said mechanical coupling means and to establish an electrical connection from the reading means to the processor through said electrical connector means.

2. A lock according to claim 1 wherein said electrical connector means comprise a set of multi-pin plug-and-socket connectors.

3. A lock according to claim 1 comprising two said cylinder units each housing a respective said barrel and reading means; the two said cylinder units being adapted to be attached to said main casing on opposite sides thereof; and said thrower bearing a coupling element adapted to be coupled to the barrels of each of said cylinder units but to be in rotary driving connection with only one of said barrels at a time.

4. A lock comprising: a bolt; a rotatable thrower for retracting the bolt; an electromechanical release mechanism which normally prevents retraction of the bolt when thrown but which can be actuated to permit such retraction; a rotatable barrel defining a keyway to receive and be turned by a proper coded key; reading means associated with the keyway for electronically transducing the code from a proper key; and processing means to receive the code transduced by said reading means and to issue a signal to actuate said release mechanism upon the recognition of a correct code;

said bolt, thrower, and release mechanism being housed within a main casing of the lock;

said barrel and reading means being housed within a cylinder unit distinct from said main casing;

said processing means being disposed within said main casing or being in communication therewith from a remote location;

said thrower and barrel having respective cooperating mechanical coupling means and said main casing and cylinder unit having respective cooperating electrical connector means;

said cylinder unit having a housing formed with a forward section through which said keyway opens to receive a proper key, and a rear section of greater cross-sectional dimension than said forward section; said barrel extending through both said forward and rear sections and presenting its respective said mechanical coupling means through the rear of said rear section; and the respective said electrical connector means of the cylinder unit being carried at the rear of said rear section at a position offset from said barrel;

whereby the lock is assembled by attaching the cylinder unit exteriorly of the main casing thereby to establish a rotary driving connection from the barrel to the thrower through said mechanical coupling means and to establish an electrical connection from the reading means to the processor through said electrical connector means.

5. A lock according to claim 4 wherein said electrical connector means comprise a set of multi-pin plug-and-socket connectors.

6. A lock according to claim 4 wherein said rear section of the housing of the cylinder unit has provision for means of attachment to said main casing at a position offset from said barrel and said electrical connector means.

7. A lock according to claim 4 wherein said reading means include an antenna adapted to produce an alternating magnetic field in a localised region of said keyway, and an oscillator for said antenna is housed within said rear section of the housing of the cylinder unit.

8. A lock according to claim 4 wherein said rear section of the housing of the cylinder unit has parts which extend both above and below said forward section when in its installed orientation.

9. A lock according to claim 4 comprising two said cylinder units each housing a respective said barrel and reading means; the two said cylinder units being adapted to be attached to said main casing on opposite sides thereof; and said thrower bearing a coupling element adapted to be coupled to the barrels of each of said cylinder units but to be in rotary driving connection with only one of said barrels at a time.

10. A lock comprising: a bolt; a rotatable thrower for retracting the bolt; an electromechanical release mechanism which normally prevents retraction of the bolt when thrown but which can be actuated to permit such retraction; a rotatable barrel defining a keyway to receive and be turned by a proper coded key; reading means associated with the keyway for electronically transducing the code from a proper key; and processing means to receive the code transduced by said reading means and to issue a signal to actuate said release mechanism upon the recognition of a correct code;

said bolt, thrower, and release mechanism being housed within a main casing of the lock;

said barrel and reading means being housed within a cylinder unit distinct from said main casing;

said processing means being disposed within said main casing or being in communication therewith from a remote location;

said thrower and barrel having respective cooperating mechanical coupling means and said main casing and cylinder unit having respective cooperating electrical connector means;

said thrower being formed in two circumjacent parts one of which is adapted to be coupled to said barrel and the other of which is blocked against rotation by said electromechanical release mechanism except when actuated as aforesaid, and said two parts are interconnected by means adapted to shear if a predetermined torque is applied to said one part while said other part is blocked.

whereby the lock is assembled by attaching the cylinder unit exteriorly of the main casing thereby to establish a rotary driving connection from the barrel to the thrower through said mechanical coupling means and to establish an electrical connection from the reading means to the processor through said electrical connector means.

* * * * *